US011136822B1

(12) United States Patent
Gazda

(10) Patent No.: US 11,136,822 B1
(45) Date of Patent: Oct. 5, 2021

(54) LADDER MOUNTED DEVICE AND SYSTEM

(71) Applicant: Tom Gazda, Scottsdale, AZ (US)

(72) Inventor: Tom Gazda, Scottsdale, AZ (US)

( * ) Notice: Subject to any disclaimer, the term of this patent is extended or adjusted under 35 U.S.C. 154(b) by 0 days.

(21) Appl. No.: 16/779,246

(22) Filed: Jan. 31, 2020

Related U.S. Application Data

(60) Provisional application No. 62/799,590, filed on Jan. 31, 2019.

(51) Int. Cl.
*E06C 7/14* (2006.01)

(52) U.S. Cl.
CPC ..... *E06C 7/14* (2013.01)

(58) Field of Classification Search
CPC ..... E06C 7/14; E06C 7/16
USPC ..... 248/238; 182/121
See application file for complete search history.

(56) References Cited

U.S. PATENT DOCUMENTS

| | | | | | |
|---|---|---|---|---|---|
| 171,742 | A | * | 1/1876 | Rote | E06C 7/16 248/238 |
| 1,376,924 | A | * | 5/1921 | Dixson | E04G 1/30 182/119 |
| 2,015,378 | A | | 9/1935 | Davis | |
| 2,398,617 | A | | 8/1944 | Casey | |
| 2,451,020 | A | | 10/1948 | Davis | |
| 2,453,355 | A | | 11/1948 | Arnold | |
| 2,496,057 | A | * | 1/1950 | Lombard | E06C 7/16 248/238 |
| 2,565,014 | A | | 8/1951 | Beaty | |
| 3,312,441 | A | * | 4/1967 | Molenda | E06C 7/14 248/210 |
| 3,396,929 | A | | 8/1968 | Brown | |
| 4,029,280 | A | | 6/1977 | Golz | |
| 4,241,807 | A | * | 12/1980 | McKenna | E06C 7/16 182/121 |

(Continued)

FOREIGN PATENT DOCUMENTS

| | | | |
|---|---|---|---|
| CN | 200955348 | Y | 10/2007 |
| CN | 205477348 | U | 8/2016 |

(Continued)

OTHER PUBLICATIONS

Step Ladder Accessories the Step Ladder Easel Workstation for Painting/Window Washing <https://www.amazon.com/Ladder-Accessories-Workstation-Painting-Washing/dp/B079SNMHLZ/ref=sr_1_1?ie=UTF8&qid=1548968896&sr=8-1&keywords=Step+Ladder+Accessories+The+Step+Ladder+Easel+Workstation+for+Painting%2FWindow+Washing>.

(Continued)

*Primary Examiner* — Bradley Duckworth
(74) *Attorney, Agent, or Firm* — Booth Udall Fuller, PLC; Bryce W. Burnham

(57) ABSTRACT

A ladder mounted system for supporting a panel during installation may include a lower hanger that may comprise a vertical support with a top end and a bottom end opposite the top end. The vertical support includes a backside configured to be oriented towards the ladder, and a frontside opposite the backside. An upper hook may be coupled to the vertical support, the upper hook being configured to be disposed over a first step of the ladder. A lower hook may be coupled to the vertical support, the lower hook being configured to be disposed over a second step of the ladder below the first step. A holding area may be disposed below the lower hook and be coupled to the vertical support for supporting the panel during installation.

18 Claims, 5 Drawing Sheets

(56) References Cited

U.S. PATENT DOCUMENTS

| | | | | |
|---|---|---|---|---|
| 4,941,547 | A * | 7/1990 | Livick | E06C 7/16 182/107 |
| 5,005,668 | A * | 4/1991 | Nowlan | E06C 7/16 182/121 |
| 5,052,515 | A * | 10/1991 | Nowlan | E06C 7/16 182/121 |
| 5,079,795 | A * | 1/1992 | Schmid | B44D 3/126 15/257.06 |
| 6,883,642 | B2 * | 4/2005 | Matty | E04G 1/20 182/107 |
| 9,022,172 | B2 * | 5/2015 | McCarthy | E06C 7/00 182/129 |
| 10,519,715 | B2 * | 12/2019 | Davis | E06C 7/14 |
| 10,731,415 | B2 * | 8/2020 | Desjardine | F16M 13/022 |
| 10,844,661 | B1 * | 11/2020 | Halloran | E06C 7/165 |
| 2003/0213646 | A1 * | 11/2003 | Gallion | E06C 7/14 182/129 |
| 2004/0069569 | A1 | 4/2004 | Fraser | |
| 2006/0196724 | A1 * | 9/2006 | Suterski | E06C 7/16 182/117 |
| 2008/0258025 | A1 | 10/2008 | Rice | |
| 2009/0147527 | A1 * | 6/2009 | O'Connor | F21V 21/00 362/396 |
| 2011/0203873 | A1 | 8/2011 | Perry | |

FOREIGN PATENT DOCUMENTS

| | | |
|---|---|---|
| GB | 1005489.8 | 10/2010 |
| JP | 2001003665 A | 8/2002 |

OTHER PUBLICATIONS

Guardian Fall Protection 2-Rung Aluminum Ladder Jack <https://www.homedepot.com/p/Guardian-Fall-Protection-2-Rung-Aluminum-Ladder-Jack-2420P/202092097>.
Camco 51492 RV Ladder Mount Bike Rack <https://www.amazon.com/Camco-51492-Ladder-Mount-Bike/dp/B06XRFFGQL>.
E-Z TV Lift <https://e-zspreadnlift.com/detailtvf.htm>.

* cited by examiner

LADDER MOUNTED DEVICE AND SYSTEM

CROSS REFERENCE TO RELATED APPLICATIONS

This application claims the benefit of the filing date of U.S. Provisional patent Application 62/799,590 entitled "Ladder Mounted Device and System" to Tom Gazda that was filed on Jan. 31, 2019, the disclosure of which is hereby incorporated herein by this reference.

TECHNICAL FIELD

This application relates to the field of ladder mounted devices and systems.

BACKGROUND

Ladders provide increased vertical access to users, which may increase freedom for accessing otherwise difficult to access spaces. Ladders come in various forms, including step ladders, extension ladders, and folding ladders, and include vertically spaced or vertically separated steps or rungs. Ladders may also be used to help facilitate work in high or difficult to access spaces by allowing a user to move up and down the steps or rungs of the ladder. Ladders have also included paint holder attachments and tool holder attachments to help facilitate work performed with the ladder.

SUMMARY

According to one aspect, a ladder mounted system for supporting a panel during installation may comprise a first lower hanger comprising a vertical support comprising a top end and a bottom end opposite the top end. The vertical support may further comprise a backside configured to be oriented towards the ladder, and a frontside opposite the backside. An upper C-shaped hook may be coupled to the backside of the top end of the vertical support. The upper C-shaped hook may be configured to be disposed over a first step of the ladder with a first step cover to be disposed over the first step of the ladder and a first lip coupled to the step cover opposite the vertical support. A lower C-shaped hook may be coupled to the backside of the vertical support below the upper C-shaped hook, the lower C-shaped hook may be configured to be disposed over a second step of the ladder below the first step with a second step cover to be disposed over the second step of the ladder and a second lip coupled to the second step cover opposite the vertical support. A holding area may be disposed below the lower C-shaped hook and coupled to the frontside of the vertical support for supporting the panel during installation. The holding area may comprise a shelf coupled to the vertical support and a shelf lip coupled to the shelf opposite the vertical support. A second lower hanger may be substantially identical to the first lower hanger and configured to be horizontally offset from the first lower hanger. A first upper hanger may comprise a vertical support comprising a top end and a bottom end opposite the top end, the vertical support further comprising a backside configured to be oriented towards the ladder, and a frontside opposite the backside. An upper C-shaped hook may be coupled to the backside of the top end of the vertical support. The upper C-shaped hook may be configured to be disposed over a third step of the ladder with a step cover to be disposed over the third step of the ladder and a lip coupled to the step cover opposite the vertical support. The third step may be higher than the first step. A lower C-shaped hook may be coupled to the backside of the vertical support below the upper C-shaped hook. The lower C-shaped hook may be configured to be disposed over a fourth step of the ladder below the third step with a step cover disposed over the fourth step of the ladder and a lip coupled to the step cover opposite the vertical support.

Particular embodiments may comprise one or more of the following features. An upper width of the vertical support at the top end of the first lower hanger is less than a width of the vertical support at the bottom end such that a panel held flush against the vertical support of the first lower hanger is reclined against the vertical support so as to reduce a risk of tipping away from the vertical support. The first lower hanger and the second lower hanger may form a set of lower hangers, the second lower hanger comprising a vertical support comprising a top end and a bottom end opposite the top end. An upper C-shaped hook may be coupled to the top end of the vertical support, the upper C-shaped hook may comprise a first step cover and a lip coupled to the first step cover opposite the vertical support. A lower C-shaped hook may be coupled to the vertical support below the upper C-shaped hook, the lower C-shaped hook comprising a second step cover and a lip coupled to the second step cover opposite the vertical support. A holding area may be disposed below the lower C-shaped hook and coupled to the frontside of the vertical support for supporting the panel during installation. The holding area may comprise a shelf coupled to the frontside of the vertical support and a shelf lip may be coupled to the shelf opposite the vertical support. The first lower hanger and the second lower hanger may be configured to be coupled to a same ladder or different ladders, bounded by rails of the ladders, and positioned at a same level of ladder steps. A second upper hanger may be substantially identical to, and horizontally offset from, the first upper hanger to form a set of upper hangers. The first upper hanger and the second upper hanger may be configured to be disposed on a same ladder or different ladders. The first step may be the same as the fourth step such that the upper C-shaped hook of the first lower hanger is coupled to the same ladder step as the lower C-shaped hook of the first upper hanger. The upper C-shaped hook and the lower C-shaped hook of both the first upper hanger and first lower hanger may be downward facing.

According to another aspect, a ladder mounted system for supporting a panel during installation may comprise a first lower hanger comprising a vertical support comprising a top end and a bottom end opposite the top end. The vertical support may further comprise a backside configured to be oriented towards the ladder, and a frontside opposite the backside. An upper C-shaped hook may be coupled to the backside of the top end of the vertical support. The upper C-shaped hook may be configured to be disposed over a first step of the ladder with a first step cover to be disposed over the first step of the ladder and a first lip coupled to the step cover opposite the vertical support. A lower C-shaped hook may be coupled to the backside of the vertical support below the upper C-shaped hook. The lower C-shaped hook may be configured to be disposed over a second step of the ladder below the first step with a second step cover to be disposed over the second step of the ladder and a second lip coupled to the step cover opposite the vertical support. A holding area may be disposed below the lower C-shaped hook and coupled to the frontside of the vertical support for supporting the panel during installation. The holding area may comprise a shelf coupled to the vertical support and a shelf lip coupled to the shelf opposite the vertical support. A second lower hanger may be substantially identical to the first lower hanger and may be configured to be horizontally offset from the first lower hanger.

Particular embodiments may comprise one or more of the following features. An upper width of the vertical support at the top end of the first lower hanger may be less than a width of the vertical support at the bottom end such that a panel held flush against the vertical support of the first lower hanger is reclined against the vertical support so as to reduce a risk of tipping away from the vertical support. The second lower hanger may comprise a vertical support comprising a top end and a bottom end opposite the top end. An upper C-shaped hook may be coupled to the top end of the vertical support, the upper C-shaped hook comprising a first step cover and a lip coupled to the first step cover opposite the vertical support. A lower C-shaped hook may be coupled to the vertical support below the upper C-shaped hook. The lower C-shaped hook may comprise a second step cover and a lip coupled to the second step cover opposite the vertical support. A holding area may be disposed below the lower C-shaped hook and be coupled to the frontside of the vertical support for supporting the panel during installation. The holding area may comprise a shelf coupled to the frontside of the vertical support and a shelf lip coupled to the shelf opposite the vertical support. The first lower hanger and the second lower hanger may be configured to be coupled to a same ladder or different ladders, be bounded by rails of the ladders, and be positioned at a same level of ladder steps. A first upper hanger may comprise a vertical support comprising a top end and a bottom end opposite the top end. The vertical support may further comprise a backside configured to be oriented towards the ladder, and a frontside opposite the backside. An upper C-shaped hook may be coupled to the backside of the top end of the vertical support. The upper C-shaped hook may be configured to be disposed over a third step of the ladder with a step cover to be disposed over the third step of the ladder and a lip coupled to the step cover opposite the vertical support. The third step may be higher than the first step. A lower C-shaped hook may be coupled to the backside of the vertical support below the upper C-shaped hook. The lower C-shaped hook may be configured to be disposed over a fourth step of the ladder below the third step with a step cover to be disposed over the fourth step of the ladder and a lip coupled to the step cover opposite the vertical support. A second upper hanger may be substantially identical to, and horizontally offset from, the first upper hanger to form a set of upper hangers. The set of upper hangers may be disposed on a same ladder or different ladders. The first step may be the same as the fourth step such that the upper C-shaped hook of the first lower hanger is coupled to the same ladder step as the lower C-shaped hook of the first upper hanger. The upper C-shaped hook and the lower C-shaped hook of the first lower hanger are downward facing.

According to another aspect, a ladder mounted system for supporting a panel during installation may comprise a first lower hanger comprising a vertical support comprising a top end and a bottom end opposite the top end. The vertical support may further comprise a backside configured to be oriented towards the ladder, and a frontside opposite the backside. An upper hook may be coupled to the vertical support, the upper hook configured to be disposed over a first step of the ladder. A lower hook may be coupled to the vertical support, the lower hook configured to be disposed over a second step of the ladder below the first step. A holding area may be disposed below the lower hook and coupled to the vertical support for supporting the panel during installation.

Particular embodiments may comprise one or more of the following features. A second lower hanger may be substantially identical to the first lower hanger and may be configured to be horizontally offset from the first lower hanger. The first lower hanger and the second lower hanger may be configured to be coupled to a same ladder or different ladders, bounded by rails of the ladders, and positioned at a same level of ladder steps. An upper width of the vertical support at the top end of the first lower hanger may be less than a width of the vertical support at the bottom end such that a panel held flush against the vertical support of the first lower hanger is reclined against the vertical support so as to reduce a risk of tipping away from the vertical support. The upper hook and the lower hook may each comprise a C-shape. A first upper hanger may comprise a vertical support comprising a top end and a bottom end opposite the top end. The vertical support may further comprise a backside configured to be oriented towards the ladder, and a frontside opposite the backside. An upper hook may be coupled to the vertical support. The upper hook may be configured to be disposed over a third step of the ladder, wherein the third step is higher than the first step. A lower hook may be coupled to the vertical support below the upper hook, the lower hook being configured to be disposed over a fourth step of the ladder below the third step. A second upper hanger may be substantially identical to, and horizontally offset from, the first upper hanger to form a set of upper hangers, the set of upper hangers being disposed on a same ladder or different ladders.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

DETAILED DESCRIPTION

Figure 1:
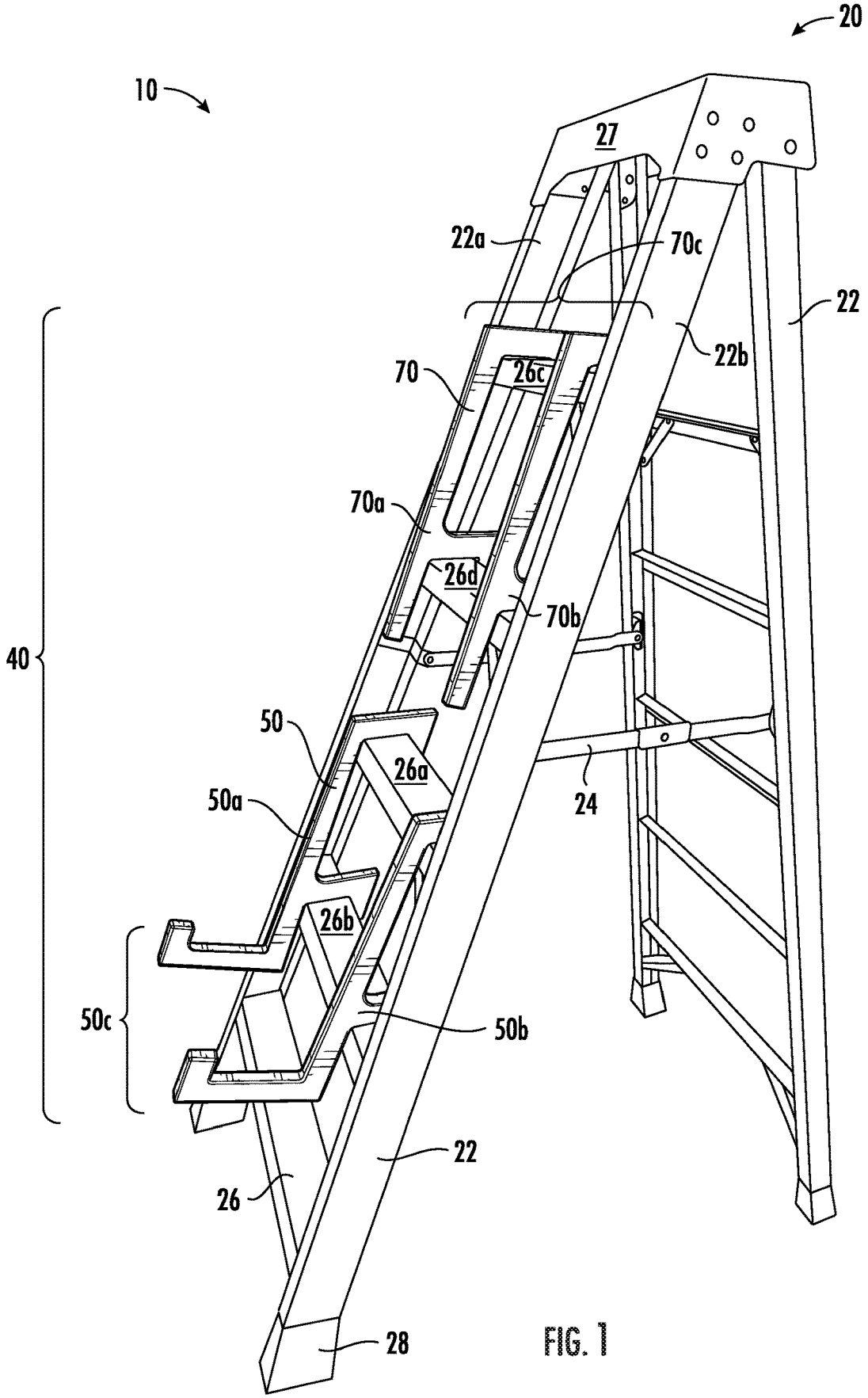
FIG. 1 shows a perspective view of four hangers coupled to a ladder.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

The present disclosure addresses a need for a system and device that can facilitate the holding and mounting of panels, such as panels 90. Disclosed herein is a ladder mounted system and device for holding and installing panels. As used herein, the term panel 90 comprises flat screen televisions, monitors, other electronics, paintings, windows, sheets of plywood, drywall, or any other object comprising large lengths and widths compared to small thickness. The ladder mounted system 10 and device for holding and installing panels described herein may be used with stepladders or step up ladders (hereinafter stepladders), single ladders, roof ladders, extension ladders, or any suitable ladders. In many instances, a person working from ground level may have sufficient height with the current system without using a stepladder for themselves, and additionally has the advantage of a stable and self-supporting base (the stepladder) onto which the system of hangers may be attached. It should be understood that the components depicted and discussed are non-limiting examples, and that the contemplated components may be combined with any of the other components in other implementations.

FIGS. 1-5 show various views and aspects of a ladder mounted system 10 for supporting panels 90 during installation. The ladder mounted system 10 comprises any desirable number of upper hangers 70 and lower hangers 50 (collectively hangers 40) that are used in holding panels 90 on a ladder 20. In some instances, such as those illustrated in the FIGs., at least one upper hanger 70 may be used, such as two upper hangers (arranged as a left or first upper hanger 70*a* and a right or second upper hanger 70*b*) or more than two hangers, such as three, four, or any number of upper hangers. A similar or identical number of lower hangers 50 may also be used such that there is an identical number of upper hangers 70 and lower hangers 50 being used, or different number of upper and lower hangers. A number of hangers 40 may be used and vary depending on a size and weight of the panel(s) 90 to be held and mounted, a number of ladders 20, or other considerations.

The hangers 40 may be made or formed of a flexible, semi-flexible, or rigid material, and can comprise plastics, including marine plastics, thermoplastics, Acrylonitrile Butadiene Styrene (ABS), polycarbonate, Kevlar, fiber materials including fiberglass or carbon fiber, or other suitable material including wood, metal, compressed textiles, cellulose based materials, particle board, fiber board, or other suitable materials. In some instances, the hangers 40 may be made or formed of High-density polyethylene (HDPE) or polyethylene high-density (PEHD). In some instances, the hangers 40 may be made of a monolithic or singular material (no more than one) material and be formed of a single unitary piece. In other instances, multiple pieces or members may be coupled or joined together, such as discretely formed hooks or holding areas being coupled to the vertical support. In other instances, pads, grips, and different layers or coatings of materials may be used in the construction or formation of the hangers. The hangers 40 may be made or formed by molding, injection molding, or any suitable molding, as well as by milling, C&C machines and by being cut from existing bulk material, such as sheets of material.

Figure 4:
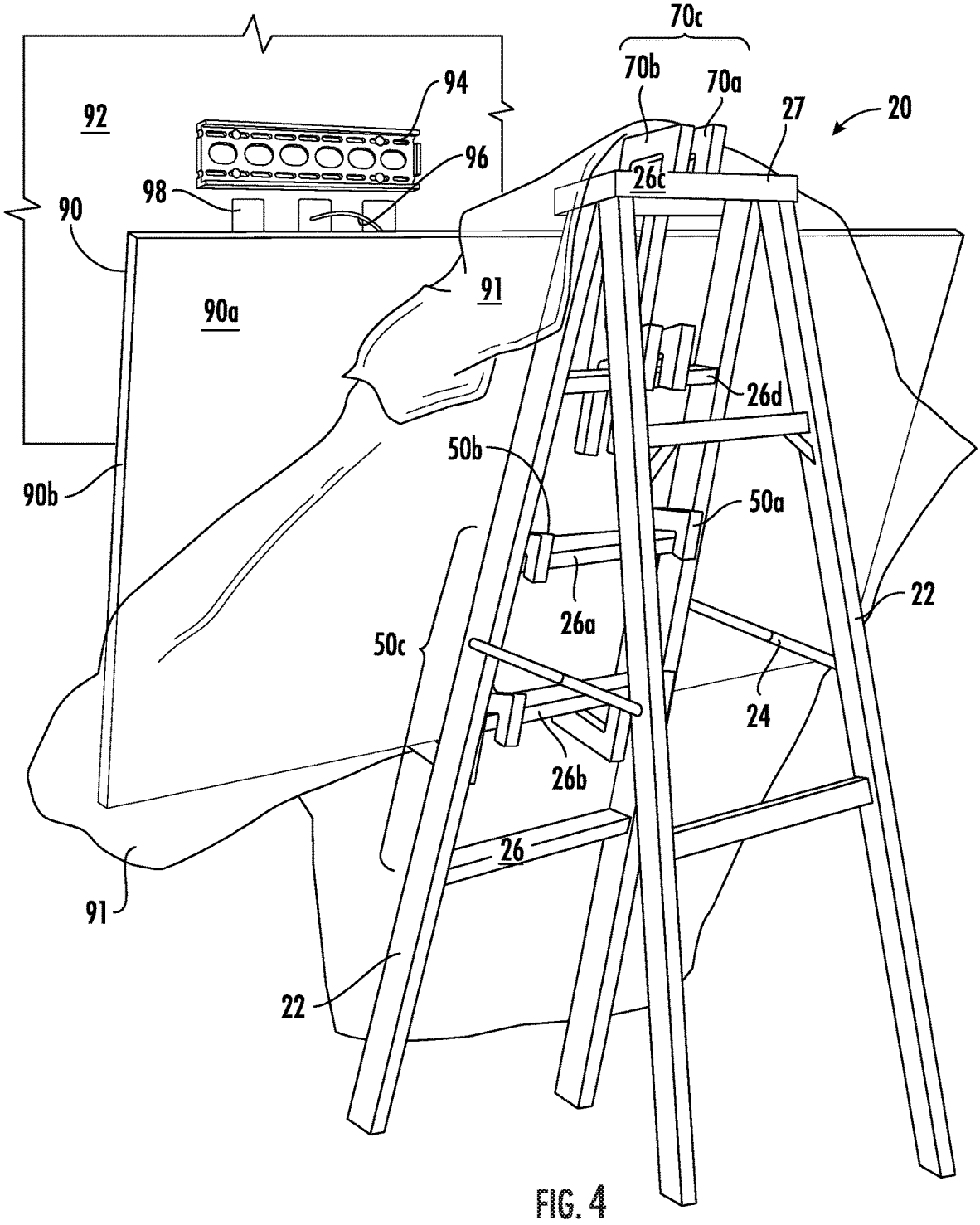
FIGS. 4 and 5 show various perspective views of four hangers coupled to a ladder and supporting a flat panel television (TV) for installation.

As shown and described with respect to the FIGs., two upper hangers 70*a*, 70*b* and two lower hangers 50*a*, 50*b* are removably coupled to the ladder 20 by having a number of hooks 54, 57, 74, 77 on the hangers 40 disposed over the steps or rungs 26 of the ladder 20. In some instances, hooks 74, 77 of one or more of the upper hangers 70 may rest on, and be coupled to, a top cap 27 of the ladder, as shown in FIG. 4, and for ease of description will hereinafter be included in subsequent references to rungs or steps 26. As such, the hangers 40 may be releasably coupled to the ladder 20 with a friction fit and without other mechanical or chemical attachment such as fasteners, bolts, nuts, screws, rivets, clamps, hook and loop fasteners, and adhesives. In some instances, one or more fewer upper hangers 70 may be used than the corresponding number of lower hangers 50. Alternatively, one or more fewer lower hangers 50 may be used than the corresponding number of upper hangers 70. In yet other instances, a same number of upper hangers 70 and lower hangers 50 will be used.

FIG. 1 shows a perspective view, or an isometric environmental view, of a ladder mounted system 10 for supporting panels 90 during installation, in which two lower hangers 50 and two upper hangers 70 are coupled to steps, ladder steps, rungs, or ladder rungs 26 of the ladder 26 between opposing rails, side members, or beams 22 of the ladder 20. As depicted in FIG. 1, the ladder 20 may also comprise spreaders or spreader assemblies 24 coupled to, and disposed between, front and rear rails 22 when a step ladder or folding ladder is used. The ladder 26 may also comprise a top cap 27 as well as feet, anti-slip feet, safety shoes, or foot pads 38 disposed at, or coupled to, lower ends or butts of the ladder 26.

As depicted in FIG. 1, four hangers are coupled to the ladder 26, a set of upper hangers 70*c*, comprising a left or first upper hanger 70*a* and a right or second upper hanger 70*b*, and a set of lower hangers 50*c* comprising a left or first upper hanger 50*a* and a right or second upper hanger 50*b*. While the terms left and right are at times employed with respect to relative orientation of the hangers from the point of view of a person facing the ladder, the designations or non-limiting and may also be understood with respect to different orientations. Similarly, while the terms first and second are also used with respect to various hangers, the ordering or numbering of the hangers is representative and not limiting.

The first lower hanger 50*a* comprises a vertical support 52 with opposing ends 53, namely a top end 53*a* and a bottom end 53*b* opposite the top end 53*a*. The term "vertical" as used herein is in reference to a spine, central connecting element, or member that allows an upward and downward span as between vertically spaced or offset steps 26 of the latter 20. The vertical support 52 need not be positioned only perpendicular to the ground or at 90° from horizontal, but may also have a slant, angle, or vector that comprises a horizontal element. However, when coupled to the ladder 60 the vertical support 52 is configured to be principally vertical or at an angle greater than or equal to 45° from the ground or from horizontal. The vertical support 52 further comprising a backside 52*a* configured to be oriented towards the ladder 26, and a frontside 52*b* opposite the backside 52*a*. The first lower hanger 50*a* comprises an upper hook or upper C-shaped hook 54 coupled to the backside 52*a* of the top end 53*a* of the vertical support 52.

The upper C-shaped hook 54 may be configured to be disposed over a first step 26*a* of the ladder 20 with a first step cover or upper step cover 55 disposed over the first step 26*a* of the ladder 20 and a first lip, upper lip, or lip 56 coupled to the step cover 55 opposite the vertical support 52. The lip 56, as well as the other lips 59, 76, and 79, may have a size that extends from their respective step covers a distance in a range of 0.5-10 centimeters (cm), or more, and provide a protection against the hanger being inadvertently removed. The size of the lips 56, 59, 76, and 79 may also account for variation among spacing or offset among steps 26, and the top cap 27, allowing the hooks 54, 57, 74 and 77 to releasably couple with the ladder 20, even with uneven spacing among the steps 26 and the top cap 27. As used herein, the "first" step 26*a* is used as a designation of a particular step distinct from the other latter designated second, third, and fourth steps, and is not limiting with respect to a particular height or position on the ladder 20, or limiting with respect to a particular sequence or relative position of the steps 26, except as expressly set forth.

The first lower hanger 50*a* also comprises a lower hook or C-shaped hook 57 coupled to the backside 52*a* of the vertical support 52 below the upper C-shaped hook 54. The lower C-shaped hook 57 is configured to be disposed over a second step 26*b* of the ladder 20 below the first step 26*a* with a second step cover 58 to be disposed over the second step 26*b* of the ladder 26 and a second lip, lower lip, or lip 50 coupled to the second step cover 58 opposite the vertical support 52. The first lower hanger 50*a* comprises a holding area 60 disposed below the lower C-shaped hook 57 and coupled to the frontside 52*b* of the vertical support 52 for supporting the panel 90 during installation of the panel, such as to a wall 92 or wall mounting bracket or frame 94, as shown, for example, in FIGS. 4 and 5. The holding area 60 comprises a shelf, tray, or ledge 62 coupled to the vertical support 52 and a lip or shelf lip 64 coupled to the shelf 62 opposite the vertical support 52.

A second lower hanger or right lower hanger 50*b* may be similar, identical, or substantially identical to the first lower hanger 50*a*, and configured to be horizontally offset from the first lower hanger 50*a*. The first lower hanger 50*a* and the second lower hanger 50*b* form a set of lower hangers 50*c*. The second lower hanger comprises a vertical support 52 comprising a top end 53*a* and a bottom end 53*b* opposite the top end 53*a*. An upper C-shaped hook 54 is coupled to the top end 53*a* of the vertical support 52, the upper C-shaped hook 54 comprising a first step cover 55 and a lip 56 coupled to the first step cover 55 opposite the vertical support 52. A lower C-shaped hook 57 is coupled to the vertical support 52 below the upper C-shaped hook 54, the lower C-shaped hook 57 comprising a second step cover 58 and a lip 57 coupled to the second step cover 58 opposite the vertical support 52. A holding area 60 is disposed below the lower C-shaped hook 57 and coupled to the frontside 52*b* of the vertical support 52 for supporting the panel 90 during installation, the holding area 60 comprising a shelf, tray, or ledge 62 coupled to the frontside 52*b* of the vertical support 52 and a shelf lip 64 coupled to the shelf 62 opposite the vertical support 52. The holding area 60 comprises a length L1 that extends from the frontside 52*b* of the vertical support 52 to the face of the lip 64 oriented towards the frontside 52*b* in a range suitable for holding panel 90, such as 2-15 cm.

A first upper hanger 70 comprises a vertical support 72 comprising opposing ends 73, such as a top end 73*a* and a bottom end 73*b* opposite the top end 73*a*, the vertical support 72 further comprising a backside 72*a* configured to be oriented towards the ladder 20, and a frontside 72*b* opposite the backside 72*a*. The first upper hanger 70 comprises an upper C-shaped hook 74 coupled to the backside 72*a* of the top end 73 of the vertical support 72. The upper C-shaped hook 74 is configured to be disposed over a third step 26*c* of the ladder 20 with a step cover 75 to be disposed over the third step 26*c* of the ladder 20 and a lip 76 coupled to the step cover 75 opposite the vertical support 72, wherein the third step 26*c* is higher than the first step 26*a*. The first upper hanger 70 also comprises a lower C-shaped hook 77 coupled to the backside 72*a* of the vertical support 72 below the upper C-shaped hook 74, the lower C-shaped hook 77 configured to be disposed over a fourth step 26*d* of the ladder 20 below the third step 26*c* with a step cover 78 to be disposed over the fourth step 26*d* of the ladder 20 and a lip 79 coupled to the step cover opposite the vertical support.

A second upper hanger 70*b* may be substantially identical to, and horizontally offset from, the first upper hanger 70*a* to form a set of upper hangers 70*c*, wherein the first upper hanger 70*a* and the second upper hanger 70*b* are configured to be disposed on a same ladder 20 or different ladders 20, such as a first ladder and a second ladder.

An upper width W1 of the vertical support 52 at the top end 53*a* of the first lower hanger 50*a* is less than a width W2 of the vertical support 52 at the bottom end 53*b*, such that a panel 90 held flush against the frontside 52*b* of the vertical support 52 of the first lower hanger 50*a* is reclined against the vertical support 52 so as to reduce a risk of the panel 90 tipping away from the vertical support 52.

The first lower hanger 50*a* and the second lower hanger 50*b* may be configured to be coupled to a same ladder 20 or different ladders 20. In either event, the first lower hanger 50*a* and the second lower hanger 50*b* may be bounded by rails 22 of the ladders 20. The first lower hanger 50*a* and the second lower hanger 50*b* may be positioned at a same level of ladder steps 26. In some instances, the first step 26*a* may be the same step as the fourth step 26*d*, such that the upper C-shaped hook 54 of the first lower hanger 50*a* is coupled to the same ladder step as the lower C-shaped hook 77 of the first upper hanger 70*a*.

As shown, the upper C-shaped hooks 54, 74 and the lower C-shaped hooks 57, 77 of the upper hangers 70 and lower hangers 50 may be downward facing, so as to be gravity fit over the steps 26 of the ladder 20.

Figure 2:
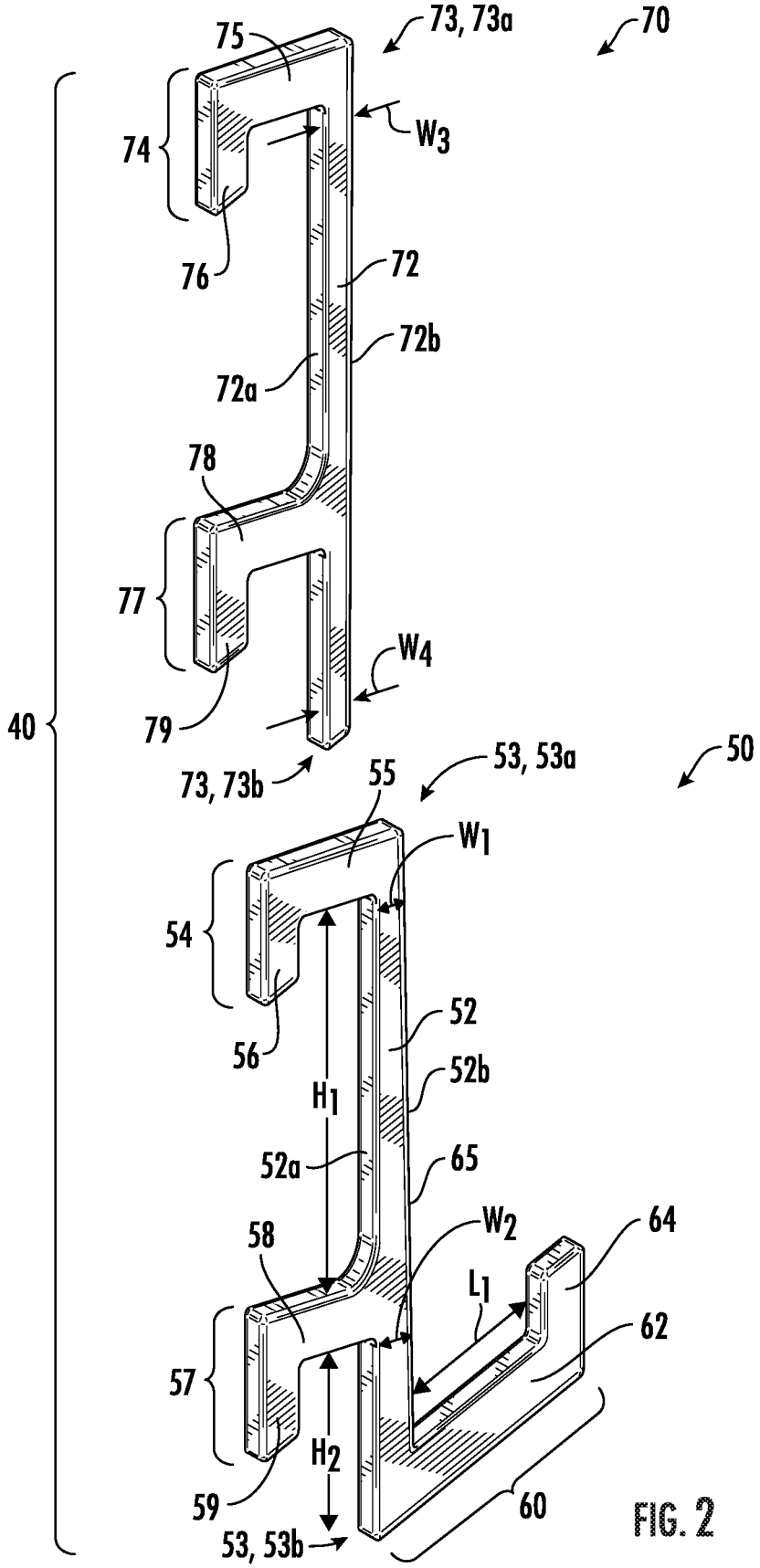
FIG. 2 shows another perspective view of an upper hanger and a lower hanger.

FIG. 2 shows another perspective view of an upper hanger 70 and a lower hanger 50, as were shown coupled to the ladder 20 in FIG. 1. As shown, an overall height of the hangers 40 may be greater than a spacing between steps 26 of the ladder 20 so as to allow the hangers 40 to couple to two or more steps 26. The hangers 40 may have an overall height (in a y-direction) in a range of, or about, 35-130 cm, 35-65 cm, or about 45 cm, 50 cm, 55 cm or other suitable height. As further shown in FIG. 2, the lower hanger 50 comprises a height or vertical offset H1 between the lower surface of the step cover 55 of the upper C-shaped hook 54 and the upper surface of the step cover 58 of the lower C-shaped hook 57. The lower hanger 50 also comprises a height or vertical offset H2 between the lower end 53 of the vertical support 52 or of the bottom surface of the holding area 60 and the lower surface of the step cover 58 of the lower C-shaped hook 57, in which H2 is less than H1. In some instances, the vertical support 52 connecting the upper hook 54 and lower hook 57 of the lower hanger 50 may also extend above the upper hook 54, such that the end 53*a* of the vertical support 52 is higher than, and offset from, the upper hook 54, and may provide additional support to a panel 90 as well as offset between or protection between the ladder 20 and the panel 90.

Figure 3:
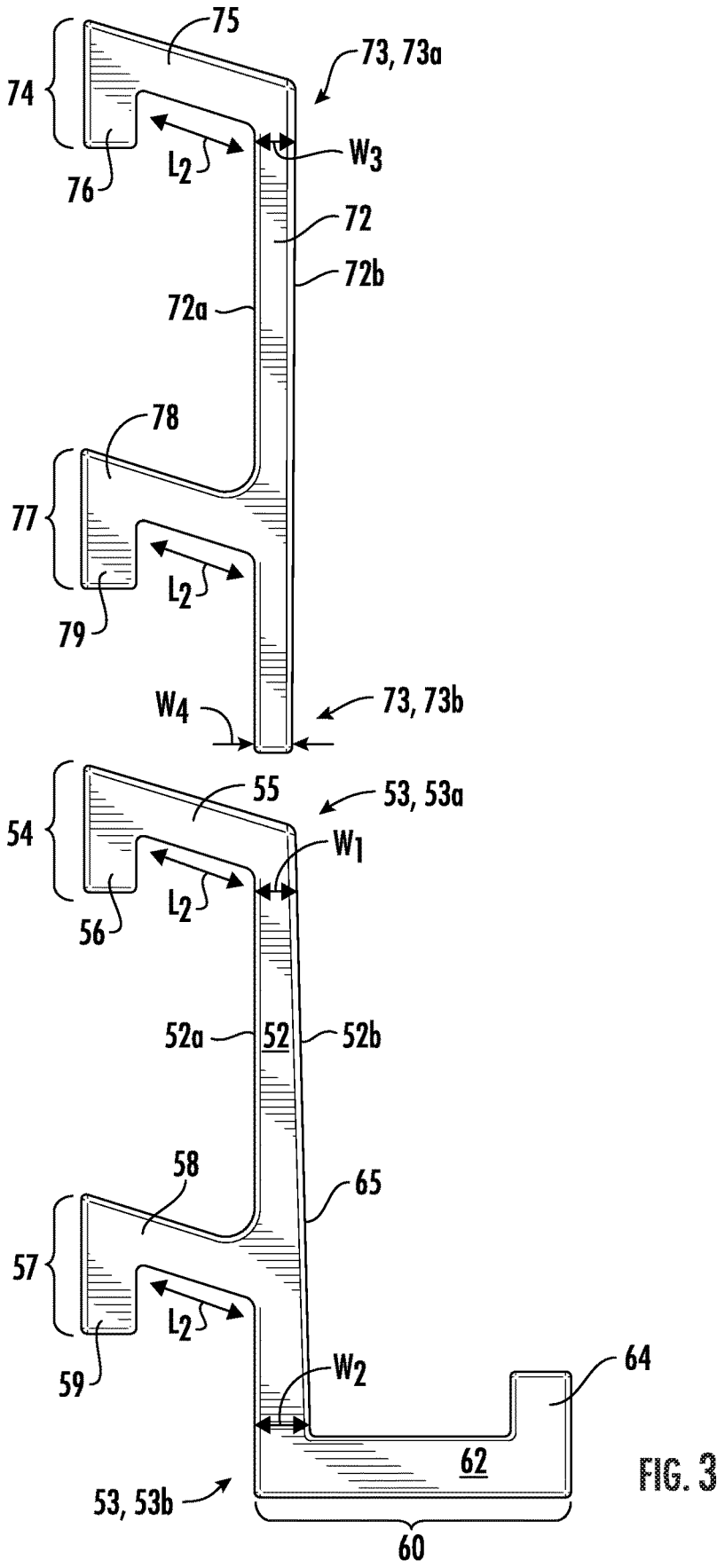
FIG. 3 shows a side view of the upper hanger and a lower hanger shown in FIG. 2.

FIG. 3 shows a side profile view of the upper hanger 70 and a lower hanger 50, similar to the perspective view shown in FIG. 2. As shown in FIG. 3, a length or inner length L2 of the step covers (first step cover 55, second step cover 58, third step cover 75, and fourth step cover 78) may extend from the backsides 52*a*, 72*a* to the frontsides of the lips 56, 59, 76, 69. The distance of the inner lengths L2 may be greater that the length or depth of the steps 26 of the ladders 20, so as to contain the steps 26 and allow the hooks 54, 57, 74, 77 to be disposed over and partially encircle the steps 26. The hangers 40 may have an overall width (in an x-direction, or in a direction of W1, W2, W3. 24, or L2) in a range of, or about, 1-5 cm, or about 2 cm, or 3 cm, or other suitable width. The hangers may have a thickness in a range of, or about, 1-2.5 cm, or about 1.5 cm, 1.8 cm, 2 cm, or other suitable thickness.

As further shown in FIG. 3, the vertical support 72 of the upper hanger 70 may be thicker or have a greater width W3 at or near a top end 73*a* and be thinner towards the bottom end 73*b*, with a lesser width W4, thus tapering from thicker to thinner down the length of the vertical support 72. To the contrary, the lower hanger 50 may tapper from thicker to thinner up the length of the vertical support 72. More specifically, the vertical support 52 of the lower hanger 50 may be thinner near a top end 53*a* with the width W1 and thicker at the bottom end 53*b* with a width W2 greater than the width W1. A thickness or dimension in a z-direction into the page of the upper hanger 70 and the lower hanger 50 may be uniform or constant, such as may a result when forming the hangers 50,70 from a planar sheet of material.

Figure 5:
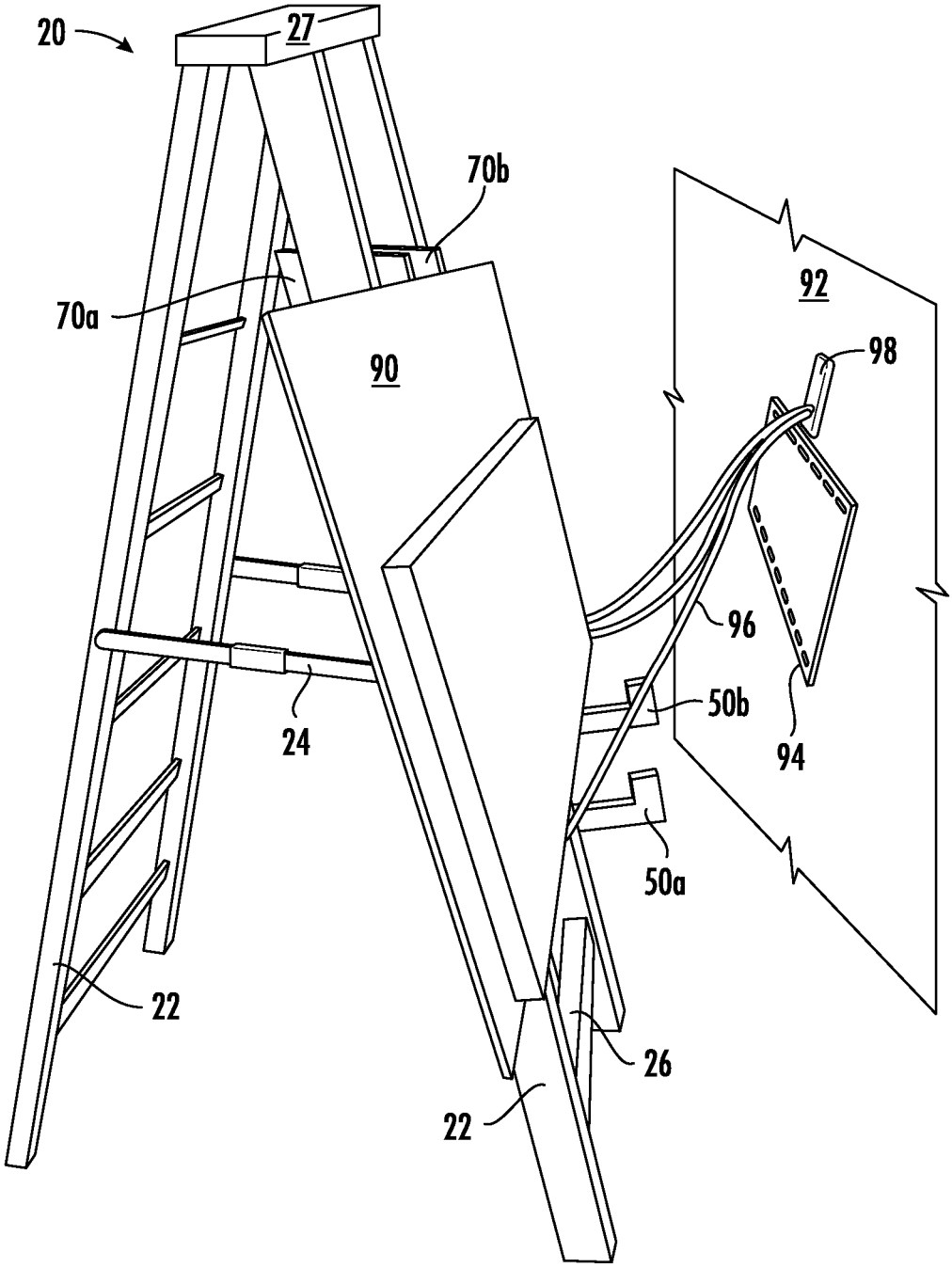

In some instance, the vertical support 52, 72 of the lower hanger 50 and the upper hanger 70, respectively, may be offset—and extend beyond—the rails 22 and steps 26 of the ladder 20 to prevent the panel 90 being held in the holding area 60 from touching or directly contacting any portion of the ladder 20. This may be particularly advantageous when the panel 90 comprises a flat panel TV and it is desirable to have the screen or display 90*a* of the TV 90 to avoid contact with the ladder 20 or any surface that could damage the TV screen 90*a*. Additionally, by having the vertical support 72 of the upper hanger 70 thicker or with a greater width W3 near the top end 73*a* of the upper hanger 70 and thicker or a greater width W2 near the lower end 53*b* of the lower hanger 50 near the holding area 60, only the rim or bezel 90*b* of the TV 90 may contact the vertical supports 52, 72. As a result, a gap or space remains between the screen 90*a* of the TV 90 and other portions of the upper hanger 70 and lower hanger 50, including the middle portions of the vertical supports 52, 72 (such as the lower portion 73*b* of the vertical support 72 of the upper hanger 70 and the upper portion 53*a* of the vertical support 52 of the lower hanger 50). Examples of the above are shown in FIGS. 4 and 5.

The corners and edges of the hangers 40 can be rounded, mitered, or beveled, so as to reduce damage such as scrapes or other undesired contact between the hangers 40 and the panels 90. In some instances, the vertical supports 52, 72 may be substantially parallel to the ladder rails 22, and the differences in width (W1, W2, W3, and W4) in the vertical supports 52, 72 may be on the order of 1-4 cm, or about 1 cm, 2 cm, or 3 cm, where "about" and "substantially" as used herein means within 5-50% difference, or a percent difference less than or equal to 40%, 30%, 20%, 15%, 10%, 7%, 5%, 3%, 2%, or 1%, such as for area, length, or other measure. In other instances, such as when a first lower hanger is substantially identical to second lower hanger, identical or substantially identical may also refer to nominal or trivial differences that may exist as a result of differences in manufacturing, such as where slight differences, inconsistencies, or variations exist as a result of multiple items being made or fashioned in a same way or subjected to a same process, but nonetheless result, or are produced with, some differences or variation. Identical or substantially identical may also refer to nominal or trivial design decisions that do not result merely from differences in manufacture.

FIG. 4 shows a perspective view of four hangers, including two lower hangers 50 and two upper hangers 70, coupled to a ladder 20 and supporting a flat panel TV 90 for installation on a wall or entertainment unit 92. A wrapper, cover, or packaging 91 is shown covering a portion of the screen 90*a* of the TV 90. A wall mounting bracket or frame 94 is shown coupled to the wall 92 for receiving the TV 90. Electrical, coaxial, power, or audio cords 96 are shown extending from the wall 92 and from the electrical wall outlets or boxes 98 for being coupled to the TV 90. By having the TV 90 resting on the ladder 90 with the hangers 70, 90, coupling of the TV 90 to the mounting bracket or frame 94 and the cords 96 at the wall 92 is facilitated, passively supporting the panel 90 at a desired position, which can be easily customized, and does not require workers to actively hold the panel 90 during installation.

As depicted in FIG. 4, the hangers 40 may be independently attached to the steps 26 of ladder 20 and be positioned to form the system 10 in which the panel 90 is prevented from directly touching or resting on the ladder 20, such that at least a portion of the vertical supports 52, 72 provide an intermediate support or cushion to the panel 90. The vertical supports 52, 72 may be positioned so as to be substantially parallel to the ladder rails 22. Furthermore, the height at which the panel 90 is supported may also be changed by adjusting the heights of one or more of the hangers 40 until a convenient position and height is created. A changed or desired height may facilitate the mounting of a TV 90, and connections of various desired electrical cords or connections 96 and mechanical connections such as with wall mounting bracket and frame 94 between the panel 90, and the wall, entertainment unit, or mounting surface 92 to which the panel or TV 90 is mounted.

Positions of hangers 40 on ladders 20 can change both horizontally, vertically, and with more or less space between upper hangers 70 and lower hangers 50. Two upper hangers 70 may be paired as a set 70*c* of substantially identical upper hangers 70*a* and 70*b*, and may form a first set of hangers 70*c* disposed on opposite ends of the same steps 26 of ladder 20. Two lower hangers 50 may be paired as a set 50*c* of substantially identical lower hangers 50, and may form a second set 50*c* of hangers 50*a* and 50*b* disposed on opposite ends of the same steps 26 of ladder 20. In some instances when additional width or spacing between hangers 40 is desired, or support points along a greater distance than can be provided by a single ladder 20, more than one ladder 20 may be used and the pairs of hangers 50*c*, 70*c* may be positioned on separate ladders 20 rather than on opposite ends of steps 26 of the same ladder 20. In some instances, rather than having two vertically separated hooks (such as 54, 57 or 74, 77) attached to vertical support 52, 72 (to form left hangers 50*a*, 70*a* and right hangers 50*b*, 70*b*) two horizontally separated hooks 54*a* and 54 *b*, 57*a* and 57*b*, 74*a* and 74*b*, or 77*a* and 77*b*, may be attached to a horizontal support to form upper and lower hangers 40, rather than left and right hangers 40.

FIG. 5 shows another perspective view of four hangers, including two lower hangers 50 and two upper hangers 70, coupled to a ladder 20 and supporting a flat panel TV 90 for installation on a wall or entertainment unit 92, similar to, and from a direction opposite of that shown in FIG. 4.

It will be understood that implementations of this ladder mounted device and system are not limited to the specific components disclosed herein, as virtually any components consistent with the intended operation of various components may be utilized. Accordingly, for example, it should be understood that, while the drawings and accompanying text show and describe particular implementations, any such implementation may comprise any shape, size, style, type, model, version, class, grade, measurement, concentration, material, weight, quantity, and/or the like consistent with the intended operation of the ladder mounted devices and system, such as for holding and installation of panels, such as flat panel TVs and other electronics.

The concepts disclosed herein are not limited to the specific ladder mounted devices and systems shown herein. For example, it is specifically contemplated that the components included may be formed of any of many different types of materials or combinations that can readily be formed into shaped objects and that are consistent with the intended operation. For example, the components may be formed of: rubbers (synthetic and/or natural) and/or other like materials; fiberglass, carbon-fiber, aramid-fiber, any combination therefore, and/or other like materials; elastomers and/or other like materials; polymers such as thermoplastics (such as ABS, fluoropolymers, polyacetal, polyamide, polycarbonate, polyethylene, polysulfone, and/or the like, thermosets (such as epoxy, phenolic resin, polyimide, polyurethane, and/or the like), and/or other like materials; plastics, marine plastics and/or other like materials; composites and/or other like materials; metals, such as zinc, magnesium, titanium, copper, iron, steel, carbon steel, alloy steel, tool steel, stainless steel, spring steel, aluminum, and/or other like materials; and/or any combination of the foregoing.

Furthermore, components and hangers of the ladder mounted devices and systems may be manufactured separately and then assembled together, or any or all of the components may be manufactured simultaneously and integrally joined with one another. Manufacture of these components separately or simultaneously, as understood by those of ordinary skill in the art, may involve 3-D printing, extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations, it should be readily apparent that a number of modifications may be made without departing from the spirit thereof and that these implementations may be applied to other implementations disclosed or undisclosed. The presently disclosed ladder mounted devices and systems, including hangers, are therefore to be considered in all respects as illustrative and not restrictive.

What is claimed is:

1. A ladder mounted system for supporting a panel during installation, comprising:

a first lower hanger comprising:

a vertical support comprising a top end and a bottom end opposite the top end, the vertical support further comprising a backside configured to be oriented towards the ladder, and a frontside opposite the backside, an upper C-shaped hook coupled to the backside of the top end of the vertical support, the upper C-shaped hook configured to be disposed over a first step of the ladder with a first step cover to be disposed over the first step of the ladder and a first lip coupled to the step cover opposite the vertical support, a lower C-shaped hook coupled to the backside of the vertical support below the upper C-shaped hook, the lower C-shaped hook configured to be disposed over a second step of the ladder below the first step with a second step cover to be disposed over the second step of the ladder and a second lip coupled to the second step cover opposite the vertical support, and a holding area disposed below the lower C-shaped hook and coupled to the frontside of the vertical support for supporting the panel during installation, the holding area comprising a shelf coupled to the vertical support and a shelf lip coupled to the shelf opposite the vertical support;

a second lower hanger substantially identical to the first lower hanger, and configured to be horizontally offset from the first lower hanger; and a first upper hanger comprising:

a vertical support comprising a top end and a bottom end opposite the top end, the vertical support further comprising a backside configured to be oriented towards the ladder, and a frontside opposite the backside, an upper C-shaped hook coupled to the backside of the top end of the vertical support, the upper C-shaped hook configured to be disposed over a third step of the ladder with a step cover to be disposed over the third step of the ladder and a lip coupled to the step cover opposite the vertical support, wherein the third step is higher than the first step, a lower C-shaped hook coupled to the backside of the vertical support below the upper C-shaped hook, the lower C-shaped hook configured to be disposed over a fourth step of the ladder below the third step with a step cover to be disposed over the fourth step of the ladder and a lip coupled to the step cover opposite the vertical support.

2. The ladder mounted system of claim 1, wherein an upper width of the vertical support at the top end of the first lower hanger is less than a width of the vertical support at the bottom end such that a panel held flush against the vertical support of the first lower hanger is reclined against the vertical support so as to reduce a risk of tipping away from the vertical support.

3. The ladder mounted system of claim 1, wherein the first lower hanger and the second lower hanger form a set of lower hangers, the second lower hanger comprising:

a vertical support comprising a top end and a bottom end opposite the top end;

an upper C-shaped hook coupled to the top end of the vertical support, the upper C-shaped hook comprising a first step cover and a lip coupled to the first step cover opposite the vertical support;

a lower C-shaped hook coupled to the vertical support below the upper C-shaped hook, the lower C-shaped hook comprising a second step cover and a lip coupled to the second step cover opposite the vertical support; and a holding area disposed below the lower C-shaped hook and coupled to the frontside of the vertical support for supporting the panel during installation, the holding area comprising a shelf coupled to the frontside of the vertical support and a shelf lip coupled to the shelf opposite the vertical support.

4. The ladder mounted system of claim 3, wherein the first lower hanger and the second lower hanger are configured to be coupled to a same ladder or different ladders, and are further configured to be positioned at a same level of ladder steps.

5. The ladder mounted system of claim 4, further comprising a second upper hanger substantially identical to, and horizontally offset from, the first upper hanger to form a set of upper hangers, wherein the first upper hanger and the second upper hanger are configured to be disposed on a same ladder or different ladders.

6. The ladder mounted system of claim 1, wherein the first step is the same as the fourth step such that the upper C-shaped hook of the first lower hanger is coupled to the same ladder step as the lower C-shaped hook of the first upper hanger.

7. The ladder mounted system of claim 1, wherein the upper C-shaped hook and the lower C-shaped hook of both the first upper hanger and first lower hanger are downward facing.

8. A ladder mounted system for supporting a panel during installation, comprising:

a first upper hanger comprising:

a vertical support comprising a top end and a bottom end opposite the top end, the vertical support further comprising a backside configured to be oriented towards the ladder, and a frontside opposite the backside, an upper C-shaped hook coupled to the backside of the top end of the vertical support, the upper C-shaped hook configured to be disposed over a third step of the ladder with a step cover to be disposed over the third step of the ladder and a lip coupled to the step cover opposite the vertical support, wherein the third step is higher than a first step, a lower C-shaped hook coupled to the backside of the vertical support below the upper C-shaped hook, the lower C-shaped hook configured to be disposed over a fourth step of the ladder below the third step with a step cover to be disposed over the fourth step of the ladder and a lip coupled to the step cover opposite the vertical support;

a first lower hanger comprising:

a vertical support comprising a top end and a bottom end opposite the top end, the vertical support further comprising a backside configured to be oriented towards the ladder, and a frontside opposite the backside, an upper C-shaped hook coupled to the backside of the top end of the vertical support, the upper C-shaped hook configured to be disposed over the first step of the ladder with a first step cover to be disposed over the first step of the ladder and a first lip coupled to the step cover opposite the vertical support, a lower C-shaped hook coupled to the backside of the vertical support below the upper C-shaped hook, the lower C-shaped hook configured to be disposed over a second step of the ladder below the first step with a second step cover to be disposed over the second step of the ladder and a second lip coupled to the step cover opposite the vertical support, and a holding area disposed below the lower C-shaped hook and coupled to the frontside of the vertical support for supporting the panel during installation, the holding area comprising a shelf coupled to the vertical support and a shelf lip coupled to the shelf opposite the vertical support; and a second lower hanger substantially identical to the first lower hanger, and configured to be horizontally offset from the first lower hanger.

9. The ladder mounted system of claim 8, wherein an upper width of the vertical support at the top end of the first lower hanger is less than a width of the vertical support at the bottom end such that a panel held flush against the vertical support of the first lower hanger is reclined against the vertical support so as to reduce a risk of tipping away from the vertical support.

10. The ladder mounted system of claim 8, wherein the second lower hanger comprises:

a vertical support comprising a top end and a bottom end opposite the top end;

an upper C-shaped hook coupled to the top end of the vertical support, the upper C-shaped hook comprising a first step cover and a lip coupled to the first step cover opposite the vertical support;

a lower C-shaped hook coupled to the vertical support below the upper C-shaped hook, the lower C-shaped hook comprising a second step cover and a lip coupled to the second step cover opposite the vertical support;

a holding area disposed below the lower C-shaped hook and coupled to the frontside of the vertical support for supporting the panel during installation, the holding area comprising a shelf coupled to the frontside of the vertical support and a shelf lip coupled to the shelf opposite the vertical support; and wherein the first lower hanger and the second lower hanger are configured to be coupled to a same ladder or different ladders, and are further configured to be positioned at a same level of ladder steps.

11. The ladder mounted system of claim 8, further comprising a second upper hanger substantially identical to, and horizontally offset from, the first upper hanger to form a set of upper hangers, the set of upper hangers being disposed on a same ladder or different ladders.

12. The ladder mounted system of claim 8, wherein the first step is the same as the fourth step such that the upper C-shaped hook of the first lower hanger is coupled to the same ladder step as the lower C-shaped hook of the first upper hanger.

13. The ladder mounted system of claim 8, wherein the upper C-shaped hook and the lower C-shaped hook of the first lower hanger are downward facing.

14. A ladder mounted system for supporting a panel during installation, comprising:

a first upper hanger comprising:

a vertical support comprising a top end and a bottom end opposite the top end, the vertical support further comprising a backside configured to be oriented towards the ladder, and a frontside opposite the backside, an upper hook coupled to the vertical support, the upper hook configured to be disposed over a third step of the ladder, wherein the third step is higher than a first step, a lower hook coupled to the vertical support below the upper hook, the lower hook configured to be disposed over a fourth step of the ladder below the third step; and a first lower hanger comprising:

a vertical support comprising a top end and a bottom end opposite the top end, the vertical support further comprising a backside configured to be oriented towards the ladder, and a frontside opposite the backside, an upper hook coupled to the vertical support, the upper hook configured to be disposed over the first step of the ladder, a lower hook coupled to the vertical support, the lower hook configured to be disposed over a second step of the ladder below the first step, and a holding area disposed below the lower hook and coupled to the vertical support for supporting the panel during installation.

15. The ladder mounted system of claim 14, wherein a second lower hanger substantially identical to the first lower hanger, is configured to be horizontally offset from the first lower hanger, wherein the first lower hanger and the second lower hanger are configured to be coupled to a same ladder or different ladders, and are configured to be positioned at a same level of ladder steps.

16. The ladder mounted system of claim 14, wherein an upper width of the vertical support at the top end of the first lower hanger is less than a width of the vertical support at the bottom end such that a panel held flush against the vertical support of the first lower hanger is reclined against the vertical support so as to reduce a risk of tipping away from the vertical support.

17. The ladder mounted system of claim 14, wherein the upper hook and the lower hook each comprise a C-shape.

18. The ladder mounted system of claim 14, further comprising a second upper hanger substantially identical to, and horizontally offset from, the first upper hanger to form a set of upper hangers, the set of upper hangers being disposed on a same ladder or different ladders.

* * * * *